United States Patent [19]

Modianos

[11] 4,063,849

[45] Dec. 20, 1977

[54] NON-CLOGGING, CENTRIFUGAL, COAXIAL DISCHARGE PUMP

[76] Inventor: Doan D. Modianos, 229 W. Robert E. Lee Blvd., New Orleans, La. 70124

[21] Appl. No.: 549,208

[22] Filed: Feb. 12, 1975

[51] Int. Cl.[2] ..... F01D 29/44

[52] U.S. Cl. ..... 415/210; 415/192; 415/215; 415/219 R

[58] Field of Search ..... 415/219, 501, 502, 213 R, 415/206, 199 A, 211, 207, 210, 209, 215, 191, 192, 193, 194, 213; 416/186; 417/424

[56] References Cited

U.S. PATENT DOCUMENTS

| | | | |
|---|---|---|---|
| 1,028,564 | 6/1912 | Forward | 415/501 |
| 1,276,154 | 8/1918 | Zoelly | 415/209 |
| 1,502,865 | 7/1924 | Moody | 415/210 |
| 1,554,591 | 9/1925 | Oliver | 415/194 |
| 1,959,710 | 5/1934 | Durdin, Jr. | 415/213 R |
| 1,971,386 | 8/1934 | Schmidt | 415/209 |
| 1,981,991 | 11/1934 | Cline et al. | 415/210 |
| 2,236,953 | 4/1941 | Schott | 415/213 R |
| 2,272,469 | 2/1942 | Lannert | 415/213 R |
| 2,449,531 | 9/1949 | Lee, Jr. | 416/177 |
| 2,483,335 | 9/1949 | Davis | 415/215 |
| 3,140,042 | 7/1964 | Fujii | 416/186 |
| 3,776,664 | 12/1973 | Kimmel | 415/501 |
| 3,936,225 | 2/1976 | Stjerstrom | 417/424 |

FOREIGN PATENT DOCUMENTS

| | | | |
|---|---|---|---|
| 139,169 | 10/1950 | Australia | 415/501 |
| 1,016,097 | 1/1966 | United Kingdom | 415/501 |

*Primary Examiner*—C. J. Husar

*Attorney, Agent, or Firm*—Paul T. O'Neil

[57] ABSTRACT

A rotatably driven, hydrodynamic, centrifugal coaxial discharge pumping apparatus for moving fluids or flows of sludge or streams with trash or solids mixed therein with a single suction, diffusion casing pump. The pump has a vertical housing with an axial fluid flow upwardly through the housing. The pump is designed to operate with a submerged inlet having non-clog and other features that are especially useful for pumping fluids flowing in sanitary and storm sewer lines, for example.

16 Claims, 9 Drawing Figures

FIG. 3
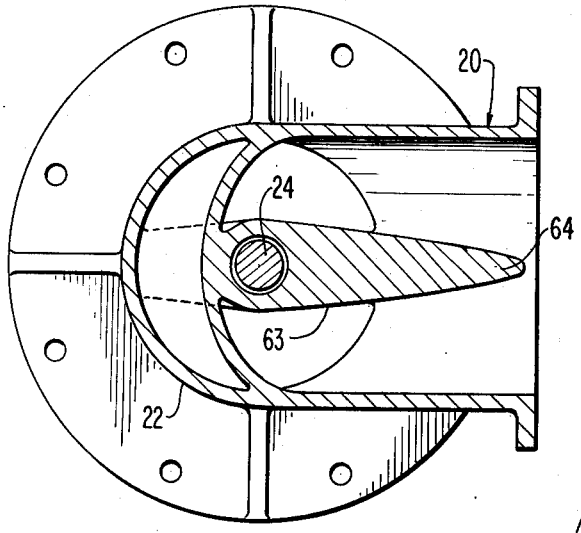
FIG. 4
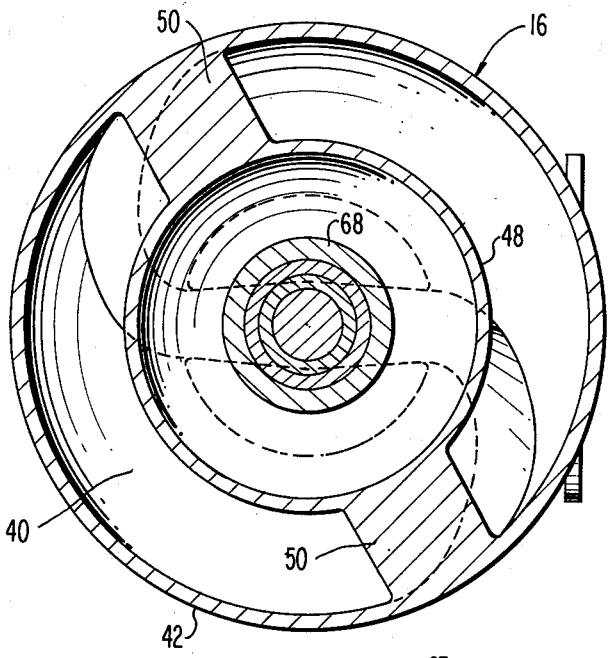
FIG. 5
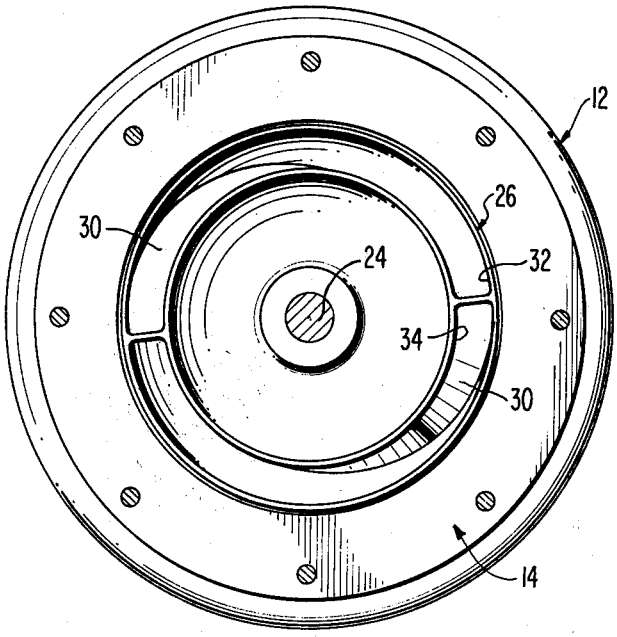
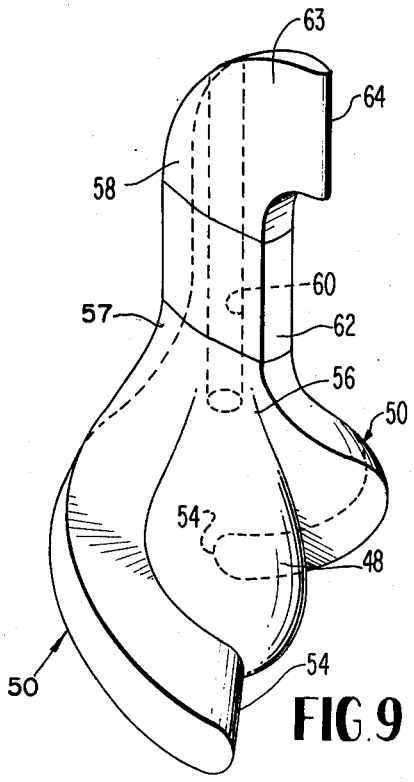
FIG. 9

FIG. 8
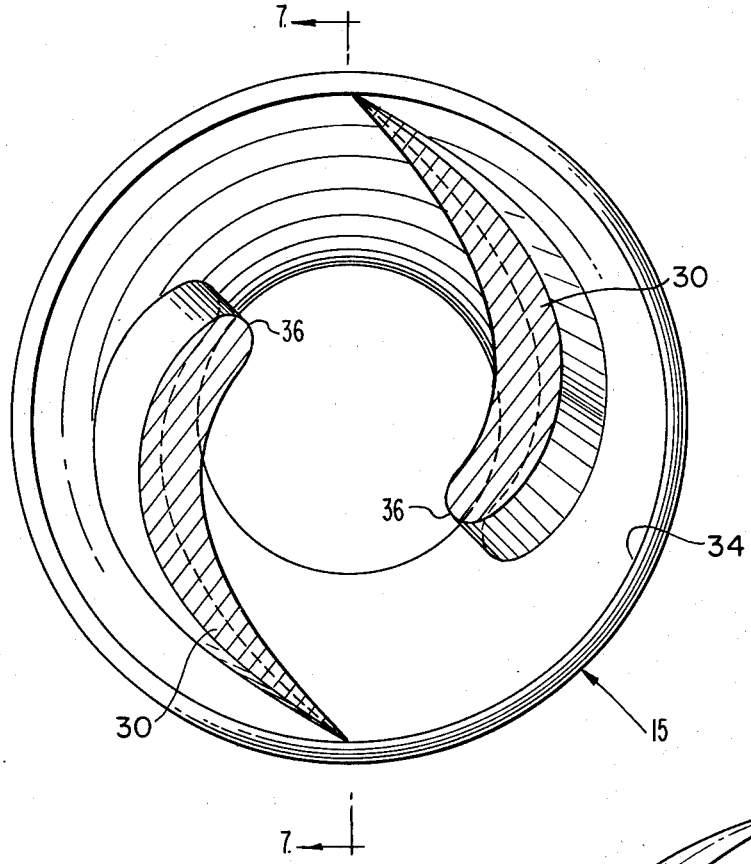
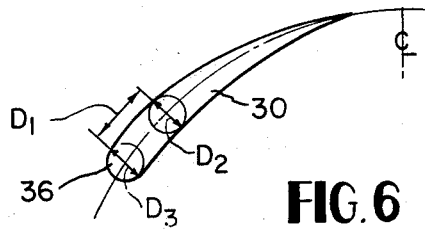
FIG. 6
FIG. 7
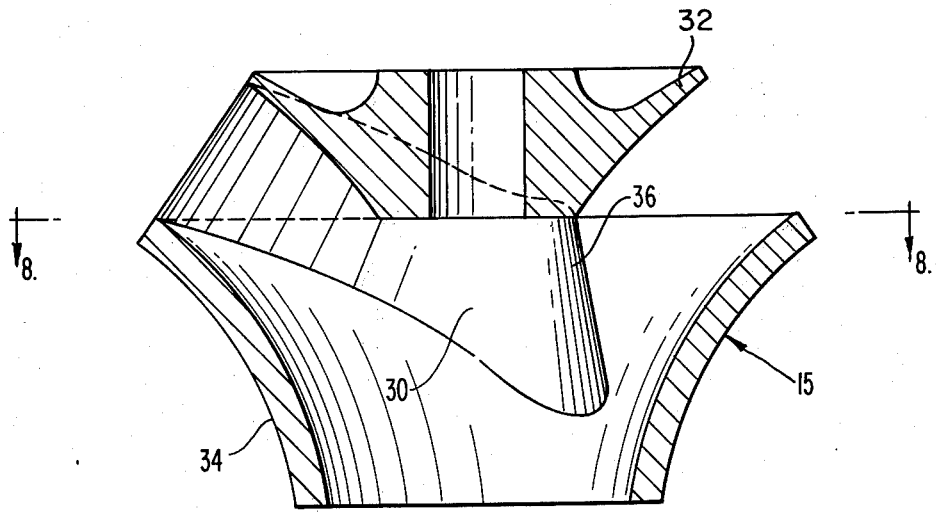

NON-CLOGGING, CENTRIFUGAL, COAXIAL DISCHARGE PUMP

PRIOR ART

Typical examples of mixed fluid flow pumps and sewage pumps are included in the following U.S. Pat. Nos.:

1,182,439 to Wood, May 9, 1916
1,502,865 to Moody, July 29, 1924
1,629,141 to Benson, May 17, 1927
1,849,127 to Wood, Mar. 15, 1932
2,647,467 to Davis, Aug. 4, 1953
3,148,464 to Jones, Sept. 15, 1964

The Wood patents disclose a typical non-clog single stage radial flow pump with a volute casing used primarily for sewage but which can also be used for other similar fluids. Moody is an example of the known horizontal, so-called "screw" pumps. Benson shows a multistage pump especially designed for deep well fluid flows, while Davis and Jones show other examples of screw type pumps. In this prior art, impeller blades with rounded leading edges for radial flow impeller pumps are shown, as in the Wood patents. Such rounded leading edges of the blades were used in conjunction with passages as large as possible in relation to the pump inlet to avoid the accumulation of trash on the impeller blades and to permit objects that passed the blades to be carried through the impeller structure to a radial discharge and then into a volute casing for discharge.

Unlike radial discharge volute type pumps, known heretofore, centrifugal coaxial discharge pumps have not been designed for advantageous pumping of liquids containing solid materials of various sizes, particularly fluids containing trashy solids such as twigs, rags, grass, and other elongated or stringy solid materials. The use of a non-clogging centrifugal coaxial discharge pump in many situations has advantages as to placement of discharge piping, as compared to radial flow volute type pumps. Most particularly, the coaxial discharge pump allows the use of the vertical suspended configuration in which the pump assembly projects into a pool of the liquid being pumped. However, the problems of handling solids-containing liquids have been so severe that such pumps have not been used to full advantage in the pumping of liquids in which trashy solids are present.

BRIEF DESCRIPTION OF THE INVENTION

The present disclosure covers a non-clog, mixed flow, coaxial discharge centrifugal pumping apparatus including an elongated vertical housing confining a pump impeller having vanes with rounded noses and a diffuser section with a housing having diffuser vanes, the bodies of the impeller and diffuser vanes being streamlined to readily pass stringy mixtures as well as solid masses through the fluid flow passage. The rounded leading ends of the diffuser vanes are rather broad as compared to the more tapered trailing ends of the diffuser vanes and also as compared with the dimensions of passageway between the vanes, namely, the effective breadth and width of the entrance to the diffuser section. The impeller vanes are widely spaced and have a minimum effective width relative to the flow passage, consistent with their streamlined configuration whereby all of the vanes present a minimum obstruction to the flow of a mixed fluid through the pump. The preferred form of the invention also includes a pair of diffuser vanes that, at the inlet end of the diffuser, are helically shaped and then straighten out to gradually direct the somewhat tangential fluid flow coming from the impellers into an axial flow, the separate diffuser vanes merging as the passage progresses toward the outlet end of the diffusion zone to form a single axially disposed vane extending to the outlet from the pump.

The nose portions of the vanes are particularly rounded so as not to retain trashy or stringy solids carried in the liquid being pumped as compared with vanes having sharper leading edges. In accordance with the invention, a much more delicate balance of forces is required to effect lodgment of such solids on the rounded edge and the normal pulsations of flow and variation in pressure will continually disturb this delicate balance and thus clean the vanes.

The pump provided by the present invention may be easily manufactured; provides for greater latitude in equipment selection and job application; operates at high efficiency with low maintenance costs; and, is especially applicable for use in a vertical position for easy insertion in sewage systems, land drainage and storm sewer locations, usually without requiring screening of the fluid being pumped.

It is therefore an object of this invention to provide a non-clog, single stage mixed flow diffusion casing pump having a coaxial discharge means.

It is another object of this invention to provide a mixed flow impeller of such special design as to be non-clogging and self-cleaning.

Another object is to provide an improved mixed-flow pump capable of discharging fluid containing solids at a higher quantity rate and operation free of cavitation and vibration over a wide range of capacities.

It is still another object of this invention to provide a novel mixed-flow pump of a design that imposes no limitation on its application.

Still another object of the invention is to provide a centrifugal, coaxial discharge pump that is non-clogging and self cleaning, in which a non-clogging mixed flow impeller is matched with non-clogging coaxial discharge components to obtain more universal adaptability for handling mixed solid and liquid flows.

Still another object of the invention is to provide an improved vertical flow pump structure.

A still further object is to provide an improved centrifugal hydrodynamic pumping apparatus.

Other objects of the invention will be obvious to those skilled in the art from the following detailed description considered in connection with the accompanying drawings in which similar reference characters denote similar elements through the several views.

IN THE DRAWINGS

FIG. 3 is a view in section taken along line 3—3 of FIG. 2;

FIG. 4 is a view in section through the diffusion chamber taken along line 4—4 of FIG. 2;

FIG. 5 is a view in section taken along line 5—5 of FIG. 2;

FIG. 6 illustrates development of the shape of a pump impeller vane, the view of the impeller vane being taken along line 6—6 of FIG. 2 (the section lines being deleted);

FIG. 7 is an enlarged fragmentary view in elevation and partly in section of a pump impeller vane and related structure;

FIG. 8 is a view in section taken along the line 8—8 of FIG. 7; and

FIG. 9 is a three-dimensional view of the diffuser vanes included in the pump shown in FIGS. 1 and 2.

DETAILED DESCRIPTION OF A PREFERRED EMBODIMENT OF THE INVENTION

Figure 1:
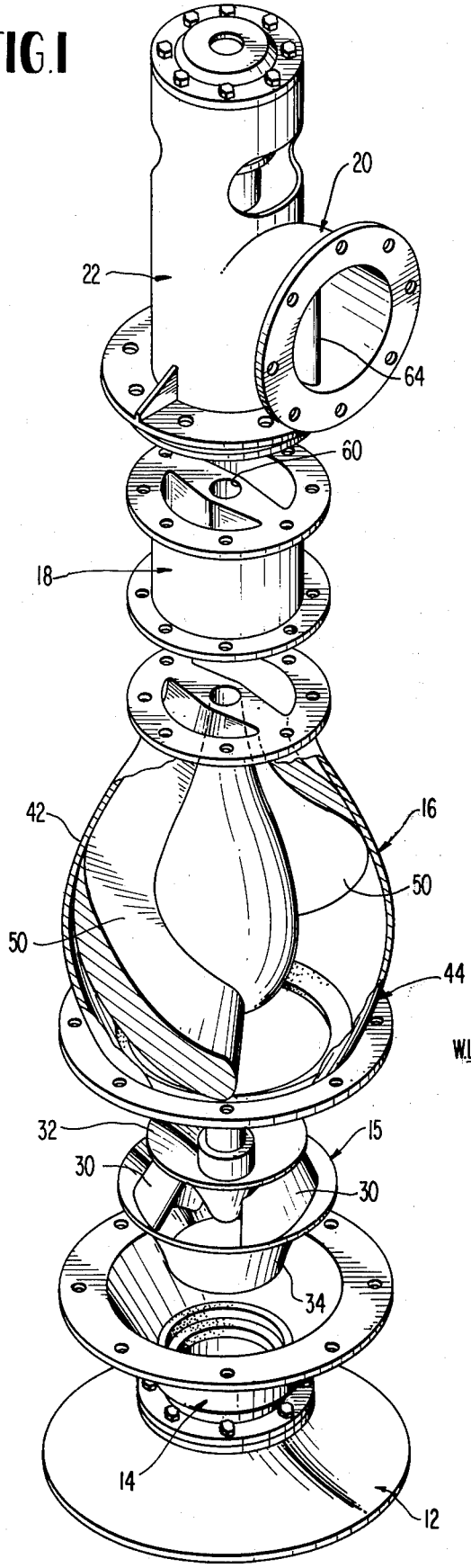
FIG. 1 is an exploded isometric view of the centrifugal coaxial discharge pump of the present invention with the wall of the diffusion chamber partly broken away.

The pump provided by the present invention has particular use for moving mixed fluid streams such as are normally encountered in sewage systems, storm sewers and some irrigation applications or land drainage activities. It is designed to move large volumes of such fluid vertically against a head of about 80 feet with a single stage, submerged suction pump, although plural stages of pumping can be used if needed to raise the liquid higher.

The pump includes an elongated housing having a vertical axis, the housing including a bell-shaped inlet 12 or other submerged suction feed means such as an elbow for feeding fluid into a suction cover 14 of the pump. The suction cover is an inverted, truncated cone having flanges at its top and bottom ends for ease of assembly and maintenance. The suction cover encloses fluid impeller means 15 to be described below and at its upper end supports a diffusion casing 16. The diffusion casing similarly has flanges at its top and bottom ends for convenience of assembly and at its upper end supports or may include a separable or integral intermediate casing section 18. The intermediate section may be selected to be of any desired length to connect the diffusion casing to a discharge elbow 20 for delivering the fluid flow produced by the pump into a suitable conduit.

The outlet or discharge elbow 20 has an integral bearing housing 22 extending upwardly therefrom to support a vertical drive shaft 24 that drives the pump impeller means 15 located within the suction cover 14. Preferably, the axis of the drive shaft coincides with the vertical axis of the housing. The pump impeller means 15 is keyed to the lower end of the drive shaft 24 and is secured to the drive shaft by a nut 28 engaging the threaded end of the shaft.

The pump is preferably a centrifugal type in which flow of the fluid and/or generation of pressure is produced by the dynamic action of a rotary impeller, the pump impeller means, which takes the form of two mixed flow impeller vanes 30 disposed 180° apart as measured in a plane perpendicular to the axis of the drive shaft. As shown in FIGS. 1, 7 and 8, the vanes 30 are spirally arranged within inner and outer curved shrouds 32 and 34 to provide a mixed flow impeller of the enclosed type, the impeller being driven in a direction to lift the fluid flowing into the suction cover upwardly through the diffusion section to the outlet. The vanes 30 are of a non-clog design each having a body portion of streamlined or roughly airfoil cross section with a rounded nose or leading edge 36 generally as shown in FIG. 6 and discussed below. The meridional flow through the impeller moves radially outwardly and axially upwardly through the housing. The rounded leading edges 36 minimize the accumulation of stringy trash on the vanes and the streamlined shape of the vanes through the confined flow passages defined by the vanes and shrouds of the impeller further encourages the free flow of various kinds of fluids through the passageways of the pump.

The flow entering the impeller means 15 is axial in direction and such flow is converted into a combined radially outward and axial upward direction by the two passageways bounded by the impeller shrouds 32 and 34 and the impeller vanes 30. Thus, according to the present invention, a smaller angle change in flow direction is required for entrance upon the vanes of the impeller means, as compared to the prior conventional non-clogging radial flow impeller, which reduces hydraulic losses and obtains greater capacity for a given rotative speed and a given differential pressure. Also, this feature results in improved performance over a wide capacity range as well as less cavitation and improved vibration characteristics.

The diffusion section 16 receives the fluid flow from the impeller means and has a passage 40 therethrough that is formed between an outer housing 42 and an inner conical member 48. The housing 42 at the bottom end 44 is curved outwardly and upwardly, as viewed in FIG. 2, that is oppositely curved with respect to the curved shape of the shroud 34. In the preferred embodiment, the two opposite curves of the shroud and housing, if extended, merge at a junction point located along a tangent line 46 common to both curves. The inner wall of the fluid passage 40 through the diffusion zone is defined by a generally concially shaped surface of the member 48.

The diffusion zone of the preferred pump additionally includes two identical diffusion vanes 50 spaced 180° apart, measured in a plane perpendicular to the axis of the drive shaft. These vanes, likewise, are of a non-clog design and have streamlined cross-sectional bodily configurations. The leading edge 54 of each of the vanes 50 is rounded as shown in FIG. 9 so that stringy material will flow easily into the flow passage 40 and to accomplish this, the leading edge of each of the vanes is set at a proper angle required for meeting the tangential velocity component of the fluid flow coming from the impeller. The leading edge of each vane 50 is spaced with sufficient clearance from the trailing edges of the impeller vanes 30 to preclude the wedging of a solid object between the rotating impeller and the stationary diffuser vanes. The trailing portion of the body of each of the vanes 50 is shaped to gradually direct the flow into an axial direction. In particular, relative to the upward direction of fluid flow, the bodies of the two diffusion vanes 50 gradually straighten out and become axially disposed vanes at their trailing or upper end portions. The axial length and shape of the inner cone 48 and the shape of the vanes 50 is such that the upper axial flow portions of the vanes exit and are joined together at the peak 56 of the cone 48 to become in effect a single wall or vane 58 producing two semi-circular coaxial flow passages upwardly to the exit from the diffusion zone. The unitary vertical diffusion vane structure 58 is provided with a center passageway 60 for receiving the drive shaft 24. If the separable intermediate section 18 is provided for extending the diffusion zone upwardly, the axial dimension of the single vane 58 is proportionally increased as represented by the vane extension 62 shown in FIG. 9. Use of such an intermediate section of any desired length provides for flexibility in design for location of the pump in any desired setting.

As seen in FIG. 3, the axial vane 58 is continued into the discharge elbow 20 in the form of the vertical vane 63 which extends into the discharge elbow 20 with its free end 64 terminating inwardly of the flanged end of the elbow. The inner edge of the vertical vane 63 merges or is joined to the discharge elbow and the vane 63 is provided with a passageway 66 for receiving the drive shaft 24.

It will be noted that the conical wall element 48 is supported from the outer wall of the diffusion section 16 by the oppositely disposed diffusion vanes 50 that may be formed integral with both the inner and outer walls of the fluid flow passage 40. Also, within the conical element 48, there is provided a bearing support means 68 for the lower end of the drive shaft 24. If desired, the bearing support means may be an integral part of the element 48 as shown. The upper end of the shaft 24 is supported by bearing means 70 supported in bearing housing 22 and the latter housing also supports a suitable shaft seal 72. Intermediate bearing means for the shaft could be provided in the intermediate section 18 if deemed desirable when the pump is used in an environment where there is a substantial difference between the water level and the discharge outlet.

The bearing housing 22 may also serve as the main bearing support pedestal for the pump structure. The several sections of the housing i.e., suction bell and suction cover, or diffusion zone and intermediate section and discharge elbow may be formed as an integral unit but are preferably designed as separate flanged elements that may be easily assembled for flexibility in design and manufacture and for mounting in various situations. The elements are adapted to be assembled with suitable seals including impeller seal rings and lubricating means to provide a simple trouble-free rugged fluid pumping apparatus.

In the diffuser section, a single vane or several vanes having an approximate shape as shown in FIG. 6 are preferred. Also, the preferred design should provide for a fluid passage, the smallest dimension of which is always larger than the smallest dimension of the impeller passages to optimize avoidance of clogging problems. In addition, it is preferred that the vertical portion of any such diffuser vane means shall include the streamlined housing for the axially disposed drive shaft and the vane should be coordinated with the drive shaft housing at the outlet elbow to minimize the possibility of build-up of trash around the shaft within the elbow. Moreover, it is preferred as suggested above that two such diffuser vanes be used to balance the hydraulic pressure on the impeller for smoother operation.

The particular design configuration of vanes 30 as illustrated in FIG. 6 are derived by following the method of error triangles for an approximate development of complex double curved surfaces of an element developed by Victor Kaplan in the 1930 era. The foil shape shown in FIG. 6 has a transverse centerline which has a length L. The distance $D_1$ of maximum thickness of the shape is located at about 26% of L from the leading end of the impeller vane. The maximum thickness $D_2$ should be about 10% of L. The curvature of the leading edge is preferably formed on a radius of 3½% of L or a diameter $D_3$ equal to 7% of L.

The shape of the diffusion vane 50 can be developed by using the same graphical system but the trailing edge 57 of that vane must be taken into account. The trailing 10% of the transverse centerline length of the curved portion of the diffusion vane constitutes the beginning of the vertically extending planar element 57 that merges into the single wall or vane 58 which in turn divides the passageway 40 into semi-circular flow passages.

In accordance with the present invention, best results in handling the debris normally found in a typical urban sewage flow are accomplished by using streamlined impeller vanes and diffuser vanes in which the maximum thickness varies between 5% to 12% of the developed transverse centerline length. The diameter of the curvature of the nose correspondingly of the vanes will vary from 3.5% of that length for the 5% thickness up to 8.4% of the centerline length at the 12% thickness according to the relationship that the nose diameter is preferably made equal to 70% of the maximum thickness.

In the preferred structure, the vanes have a maximum thickness of about 10% of the length of the transverse centerline and a leading edge diameter of about 7% of that length.

The operation of the pump provided by the present invention will be obvious from the description above. The preferred form of this invention employs a single stage pump; however, it is apparent that a multi-stage, serially arranged centrifugal pump embodying the principles of the invention could be used if the additional pumping capacity is needed.

Figure 2:
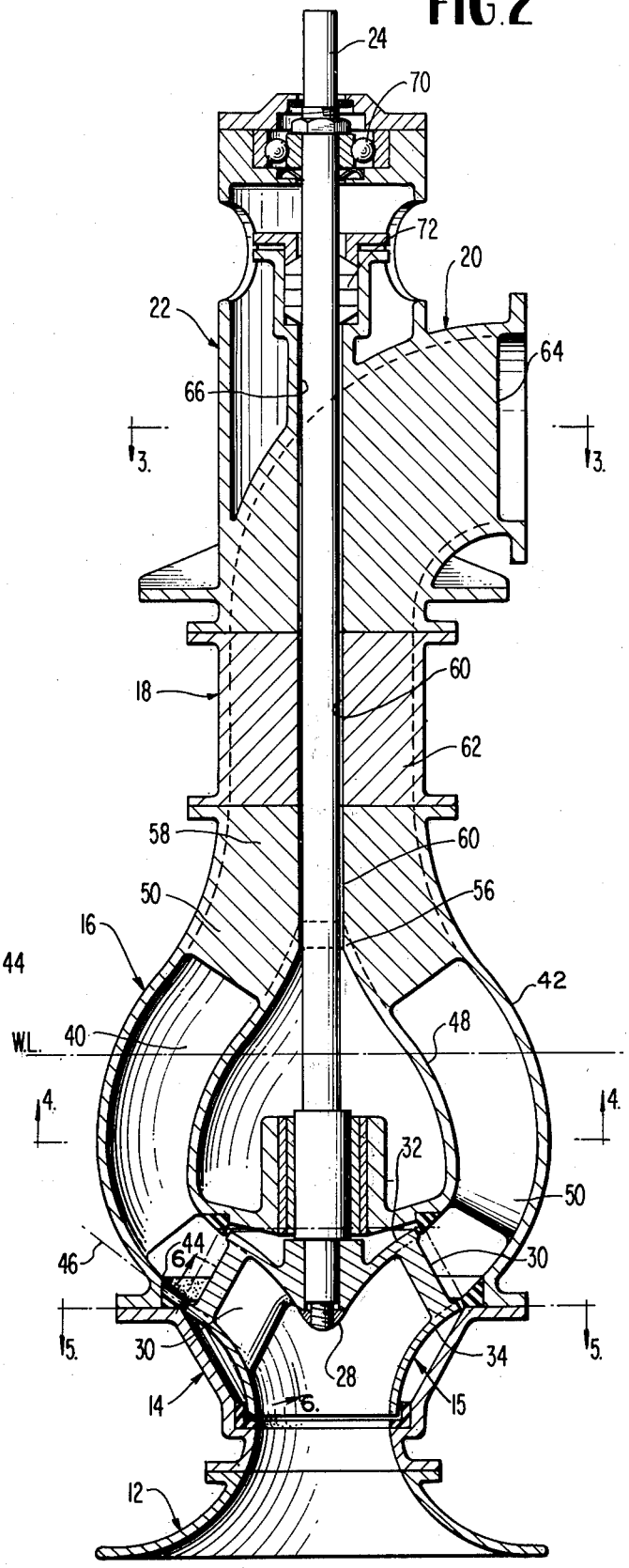
FIG. 2 is a cut away side elevation of an assembled pump of the type shown in FIG. 1.

With the inlet end of the housing submerged to about the water level indicated by the letters W.L. in FIG. 2, the fluid flow from the impeller means moves into the diffusion means which provides a diffusion flow passage for the fluid that is defined by the outer casing and the conical inner member so that the fulid is confined to a passageway between the outer casing and the conical inner member. This construction provides a means wherein the fluid is confined between these two surfaces of revolution to be most efficiently carried onward toward the discharge. Such a passage having the two vanes 50 disposed therein as described above is uniquely adapted to receive the somewhat tangentially moving fluid flow from the centrifugal pump here shown in a manner to produce a minimum of turbulence therein, while at the same time, together with vanes 50, redirect the flowing stream into the coaxial flow passages on each side of the vertical vane in the discharge end of the diffusion zone.

The above description sets forth the preferred structure of this invention; modifications thereof may occur to those skilled in the art that will fall within the scope of the following claims.

I claim:

1. A non-clogging pump for moving mixed solid and fluid flows such as sewage and similar sludges comprising an elongated housing means disposed with its axis arranged generally vertically, said housing means having a flow passage therethrough for said fluid and having a suction bell inlet to said passage at its lower end and an outlet from said passage at its upper end, a rotatably driven pump impeller confined within the housing above the inlet end of said housing for raising and moving fluid in said passage from below the inlet to the outlet, the passage in the housing including an impeller portion and a diffusion zone between the pump impeller and the outlet, said impeller including a plurality of spiral shaped vanes, each of said vanes having a rounded nose and a streamlined configuration, means to drive said impeller to produce an upwardly moving tangential fluid flow in said passage, stationary vane means in said diffusion zone, said stationary vane means having a rounded nose and a streamlined configuration, and the nose end of said stationary vane means being positioned to face directly into the fluid flow from the impeller means, the body of said stationary vane means beyond its nose gradually straightening out in the direction of fluid flow through the diffusion zone and terminating in a vertically disposed portion at the outlet, the impeller portion of said housing above said inlet being of inverted generally conical shape and said impeller being confined substantially within said cone, said drive means for said impeller including a rotatably driven shaft extending vertically through the housing, said impeller being secured to the lower end of said drive shaft for rotation therewith, said impeller including inverted truncated generally conical shroud elements integral with said impeller vanes, and said shroud elements being spaced apart in generally parallel relationship to the inverted conical housing whereby to form a confined diverging fluid flow passage through the impeller for accelerating the movement of fluid over said vanes.

2. A non-clogging pump for moving mixed solid and fluid flows such as sewage and similar sludges comprising an elongated housing means disposed with its axis arranged generally vertically, said housing means having a flow passage therethrough for said fluid and having a suction bell inlet to said passage at its lower end and an outlet from said passage at its upper end, a rotatably driven pump impeller confined within the housing above the inlet end of said housing for raising and moving fluid in said passage from below the inlet to the outlet, the passage in the housing including an impeller portion and a diffusion zone between the pump impeller and the outlet, said impeller including a plurality of vanes, each of said vanes having a rounded nose and a streamlined configuration, means to drive said impeller to produce an upwardly moving tangential fluid flow in said passage, stationary vane means in said diffusion zone, said stationary vane means having a rounded nose and a streamlined configuration, and the nose end of said stationary vane means being positioned to face directly into the fluid flow from the impeller means, the body of said stationary vane means beyond its nose gradually straightening out in the direction of fluid flow through the diffusion zone and terminating in a vertically disposed portion at the outlet, the impeller portion of said housing above said inlet being generally in the shape of an inverted cone and said impeller being confined substantially within said cone, said drive means for said impeller including a rotatably driven shaft extending vertically through the housing, said impeller being secured to the lower end of said drive shaft for rotation therewith, said impeller including inverted truncated generally conical shroud elements integral with said impeller vanes, said shroud elements being spaced apart in generally parallel relationship to the cone of the housing whereby to form a confined diverging fluid flow passage through the impeller for accelerating the movement of fluid over said vanes, said diffusion zone includes a correspondingly diverging entrance to the fluid passage in said zone to receive the fluid from the impeller, said passage beyond the entrance to the diffusion zone being shaped to converge the fluid flow inwardly toward the axis to the housing as it flows upwardly in the diffusion zone to said outlet, the fluid passage in said diffusion zone being defined by the outer wall of said housing and an inner wall spaced therefrom, said inner wall being a generally upright conical shape supported from said outer wall by said stationary vane means, and said stationary vane means comprises two vanes which merge together and form a single vane means at the top of the upright conical inner wall.

3. A structure as defined in claim 2 wherein said outlet from the housing includes a 90° elbow to deliver the fluid into a horizontally disposed conduit and said vertically disposed vane extends through the elbow substantially to said conduit.

4. A structure as defined in claim 3 wherein the vertical vane in said elbow coincides with a vertical plane defined by the sweep of the raidus of the elbow.

5. A structure as defined in claim 4 wherein said vertical vane in the diffusion zone has an enlarged hollow axially aligned center body portion and said enlarged hollow part of the body portion in said vane constituting a housing for said vertically extending drive shaft.

6. A non-clogging pump for moving mixed solid and fluid flows such as sewage and similar sludges comprising an elongated housing means disposed with its axis arranged generally vertically, said housing means having a flow passage therethrough for said fluid and having an inlet to said passage at its lower end and an outlet from said passage at its upper end, a rotatably driven pump impeller confined within the housing above the inlet end of said housing for raising and moving fluid in said passage from below the inlet to the outlet, the passage in the housing including a diffusion zone between the pump impeller and the outlet, said impeller including a plurality of vanes, each of said vanes having a rounded nose and a streamlined configuration, means to drive said impeller to produce an upwardly moving tangential fluid flow in said passage, stationary vane means in said diffusion zone, said stationary vane means having a rounded nose and a streamlined configuration, the nose end of said stationary vane means being positioned to face directly into the fluid flow from the impeller means, the body of said stationary vane means beyond its nose gradually straightening out in the direcrion of fluid flow through the diffusion zone and terminating in a vertically disposed portion at the outlet, the fluid passage in said diffusion zone is defined by the outer wall of the housing and an inner upright by the outer wall of the housing and an inner upright generally conical wall, and said conical wall being supported from said housing by said stationary vane means.

7. A structure as defined in claim 6 wherein said upright cone is axially aligned with the axis of said housing and said stationary vane means comprise two vanes each of which become straightened out, said vanes being joined together to form an integral vane means at the top of the upright conical inner wall.

8. A structure as defined in claim 7 wherein said outlet from the housing includes a 90° elbow to deliver the fluid into a horizontally disposed conduit and said vertically disposed vane extends through the elbow substantially to said conduit.

9. A structure as defined in claim 8 wherein the vertically disposed vane coincides with a vertical plane defined by the sweep of the radius of the elbow.

10. A structure as defined in claim 9 wherein said vertical vane in the diffusion zone has an enlarged hollow axially aligned center body portion, said impeller drive means including a vertically disposed drive shaft, and said enlarged hollow part of the body portion in said vane constituting a housing for said drive shaft.

11. A structure as defined in claim 9 wherein said impeller is secured on the lower end of said drive shaft.

12. A non-clogging centrifugal pump for moving mixed solid and fluid flows such as sewage and similar sludges comprising a housing having an inlet and outlet and a generally vertically disposed axis, impeller means at said inlet, said impeller means being operative to produce a radially outward and axially upward somewhat tangential fluid flow, and a diffusion zone in said housing having inner and outer walls to define a flow passage, said walls being defined by surfaces of revolution and being arranged to receive the fluid flow from said impeller means, a pair of diffuser vanes in said flow passage, each of said diffuser vanes having rounded noses and bodies that are streamlined in cross section, the nose of each of said diffuser vanes being turned to face into said on-coming fluid flow from the impeller means, and the remainder of the body of each of said diffuser vanes being turned to straighten up to coincide with the axis of said housing, and said vanes being merged together after their bodies become straightened to form a single vertical vane in said diffusion zone.

13. A structure as defined in claim 12 wherein said outlet takes the form of a discharge elbow and said vertical vane extends through said elbow, and said vane lies in a plane that includes the axis of the housing and an arc generated by the sweep of the radius of curvature of the elbow.

14. A non-clogging centrifugal pump for moving mixed solid and fluid flows such as sewage and similar sludges comprising a housing having an inlet and outlet and a generally vertically disposed axis, impeller means at said inlet, said impeller means being operative to produce a radially outward and axially upward somewhat tangential fluid flow, and a diffusion zone in said housing having inner and outer walls to define a flow passage, said walls being defined by surfaces of revolution and being arranged to receive the fluid flow from said impeller means, a pair of diffuser vanes in said flow passage, each of said diffuser vanes having rounded noses and bodies that are streamlined in cross section, the nose of each of said diffuser vanes being turned to face into said on-coming fluid flow from the impeller means and the remainder of the body of each of said diffuser vanes being turned to straighten up to coincide with the axis of said house, and each diffuser vane including a leading end and trailing end and a transverse centerline having a curved portion, a maximum thickness of between 5% and 12% of the length of the curved portion of the centerline, the curvature of the leading end having a diameter equal to 70% of the maximum thickness, and the point of maximum thickness is about 26% of the length of the curved portion of the centerline displaced from the leading end.

15. A structure as defined in claim 14 wherein the maximum thickness is 10% of the length of the centerline and the nose diameter is 70% of the maximum thickness.

16. A structure as defined in claim 14 in which said impeller includes generally spirally arranged vanes having rounded noses and bodies that are streamlined in cross section to produce an outwardly radial and upwardly moving flow of fluid, and in which the vanes of the impeller each have leading and trailing ends and a transverse center line, a maximum thickness between 5% to 12% of the length of the center line, and with the curvature of the nose having a diameter equal to 70% of the maximum thickness and the point of maximum thickness being 26% of the length of the center line from the leading edge of the vane.

* * * * *

UNITED STATES PATENT OFFICE

CERTIFICATE OF CORRECTION

Patent No. 4,063,849 Dated December 20, 1977

Inventor(s) D. D. Modianos

It is certified that error appears in the above-identified patent and that said Letters Patent are hereby corrected as shown below:

Column 1, line 62, before "passageway", insert --the--;

Column 6, line 34, change "fulid" to --fluid--;

Column 8, line 38, change "raidus" to --radius--;

Column 9, line 5, change "direcrion" to --direction--;

Column 9, line 9, delete "and an inner upright";

Column 9, line 10, delete "by the outer wall of the housing".

Signed and Sealed this

Third Day of July 1979

[SEAL]

Attest:

Attesting Officer

LUTRELLE F. PARKER

Acting Commissioner of Patents and Trademarks